US005894640A

United States Patent [19]

Dewey

[11] Patent Number: 5,894,640

[45] Date of Patent: Apr. 20, 1999

[54] SHOE FASTENING DEVICE

[76] Inventor: Sharon L. Dewey, 861 E. 1000 Rd., Lawrence, Kans. 66047

[21] Appl. No.: 09/014,307

[22] Filed: Jan. 27, 1998

Related U.S. Application Data

[60] Provisional application No. 60/037,118, Feb. 5, 1997.

[51] Int. Cl.[6] ..... A43C 11/00

[52] U.S. Cl. ..... 24/306; 24/573.1; 24/712; 24/713.6

[58] Field of Search ..... 36/50.1; 24/442, 24/306, 712, 713, 713.1, 713.6, 573.1

[56] References Cited

U.S. PATENT DOCUMENTS 3,205,544 9/1965 Streule et al. .
4,079,527 3/1978 Antonius .
4,081,916 4/1978 Salisbury .
4,126,951 11/1978 Antonius .
4,296,558 10/1981 Antonius .
4,451,995 6/1984 Antonius .
4,907,352 3/1990 Ginsberg .
5,027,482 7/1991 Torppey ..... 24/306 X
5,557,864 9/1996 Marks ..... 24/306 X

*Primary Examiner*—James R. Brittain
*Attorney, Agent, or Firm*—Richard C. Litman

[57] ABSTRACT

A shoe fastening device designed to replace the laces of a shoe, made up of an eyelet member and an insert member, both being attachable to the eyelet tabs of a shoe using locking nylon cable ties. The eyelet member further has a slotted aperture for receiving a foldable insert tab of the insert member. Hook-and-loop-type fastening material is present along the upper surface of the insert member, whereby the insert tab may be inserted through the eyelet member and then folded upon itself, thereby allowing the shoe to be removably fastened without the complication of shoelaces.

10 Claims, 3 Drawing Sheets

SHOE FASTENING DEVICE

CROSS-REFERENCE TO RELATED APPLICATION

This application claims the benefit of U.S. Provisional Patent application Ser. No. 60/037,118, filed Feb. 5, 1997.

FIELD OF THE INVENTION

The present invention relates to shoe fastening devices designed to replace shoe laces.

DESCRIPTION OF RELATED ART

Inventors have attempted to improve upon the shoelace for quite sometime, as shoelaces often become loose upon the flexing of the foot. Furthermore, the act of shoelace tying requires a manual dexterity that makes the exercise extremely difficult for children, the elderly, the disabled and other individuals with limited hand movement, such as sufferers of arthritis or Carpal-Tunnel Syndrome.

Hook-and-loop-type fastening devices, such as VELCRO®, have been utilized on shoes for quite some time. Nevertheless, purchasers shopping for shoes fastenable with hook-and-loop-type fasteners still have a narrow range of choices, as there are not many shoes of this type available on the market.

U.S. Pat. Nos. 4,079,527 (Mar. 21, 1978), 4,126,951 (Nov. 28, 1978), 4,296,558 (Oct. 27, 1981) and 4,451,995 (Jun. 5, 1984), all issued to Antonious, describe shoes with hook-and-loop-type fastening means. However, these apparatuses are a fixed part of the shoe, making the shoe quite expensive. Furthermore, individuals under a temporary disability such as a broken hand must buy a new pair of shoes for an Antonious hook-and-loop-type fastening device.

Shoelace replacement devices designed for retrofit with shoes having laces and eyelets are known in the prior art. U.S. Pat. No. 3,205,544 which issued to Streule et al. on Sep. 14, 1965, discloses a retrofit closing device for shoes, the means for closing consisting of self-adhering fabrics. The invention employs brackets for mounting on a shoe. These brackets, however, have a fixed width, and therefore, cannot fit different shoes having variable distances between eyelets. Furthermore, these brackets are all too easily removed by a child, yet at the same time are difficult for an elderly person to insert. U.S. Pat. No. 4,081,906 which issued to Salisbury on Apr. 4, 1978, discloses a retrofit lace tightener for shoes comprising a shoelace threaded through shoe eyelets and then through a flap with hook-and-loop-type fasteners. The lace tightener is further removably attachable to a second patch of hook-and-loop-type-fasteners permanently mounted on the outer surface of the shoe. However, lacing the shoe is a difficult process requiring manual dexterity to properly adjust the tension of the laces.

U.S. Pat. No. 4,907,352 which issued to Jay Ginsberg on Mar. 13, 1990, discloses a shoelace replacing and fastening device. One embodiment comprises rigid U-shaped eyelet members and a second embodiment comprises rigid base plates. Both embodiments removably attach with screws and threaded fasteners to the eyelets of a shoe. Nevertheless, these embodiments significantly reduce the flexibility of the shoe, resulting in possible discomfort to the wearer. Additionally, both embodiments lack the adaptability to fit different shoes with variably spaced eyelets. Furthermore, the tiny screws used for attachment are in danger of being lost or swallowed by small children.

None of the above inventions and patents, taken either singularly or in combination, is seen to describe the instant invention as claimed. Thus, a shoe fastening device solving the aforementioned problems is desired.

SUMMARY OF THE INVENTION

The present invention provides a shoe fastening device designed to replace the laces of a shoe. The fastening device comprises an eyelet member and an insert member, both being attachable to the eyelet tabs of a shoe using locking nylon cable ties. The eyelet member further has a slotted aperture for receiving a foldable insert tab of the insert member. Hook-and-loop-type fastening material is present along the upper surface of the insert member, whereby the insert tab may be inserted through the eyelet member and then folded upon itself, removably fastening the shoe.

Accordingly, it is a principal object of the invention to provide a device for fastening shoes without the need of experiencing the difficulty of having to tie shoelaces.

It is another object of the invention to provide such a device that can be used in the eyelets of conventional laced shoes.

It is a further object of the invention to provide a device for fastening shoes that may be removed, returning the shoe to its original laced state.

It is yet another object of the invention to provide a device for fastening shoes that has universal application in that it is useful regardless of the spacing of the eyelets of the shoes.

It is an object of the invention to provide improved elements and arrangements thereof in a shoe fastening device for the purposes described which is safe, inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
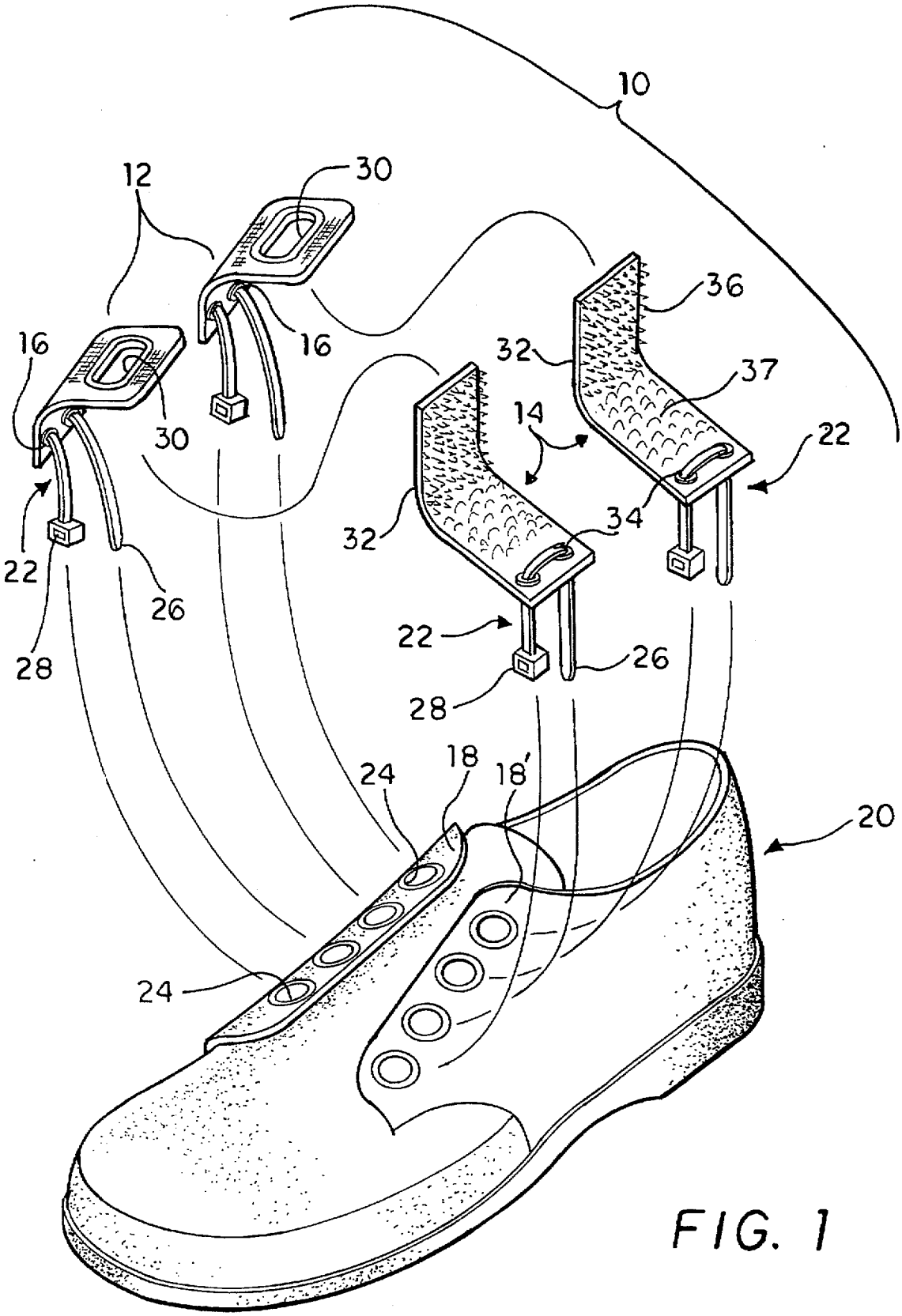
FIG. 1 is an exploded view of a shoe fastening device according to the present invention used in conjunction with a conventional shoe.

Referring now to the drawings wherein like numerals represent like elements, FIG. 1 shows an exploded view of a shoe fastening device 10 in accordance with the preferred embodiment of the present invention. The device 10 includes an eyelet member 12 and an insert member 14, both of which are comprised of a plastic material such as vinyl, although other materials may be used in alternative embodiments. The eyelet member 12 and the insert member 14 are disposed to be attached to opposed eyelet tabs 18, 18' present on the upper portion of a shoe 20. The shoe 20 is shown in FIG. 1 with the shoelaces (not shown) removed.

The eyelet member 12 of the present invention has a pair of apertures 16 at the proximal end for attachment of the eyelet member 12 to the eyelet tab 18. The means for attachment of the eyelet member 12 to the eyelet tabs 18 is accomplished by inserting a locking nylon cable tie 22 first through the pair of apertures 16 and then through eyelets 24 of the eyelet tab 18. A tapered end 26 of the cable tie 22 is then inserted into a locking receiving end 28 of the cable tie. The tapered end 26 is pulled through until the eyelet member 12 is securely attached to the eyelet tab 18 of the shoe 20, whereupon the tapered end 26 is cut off. In the preferred embodiment, the eyelet member 12 is attached with a locking nylon cable tie 22, although other means of attachment may be used in alternative embodiments. The eyelet member 12 includes a slotted aperture 30 present on the distal end of the eyelet member, for receiving an insert tab 32 of the insert member 14.

The insert member 14 of the present invention has a pair of apertures 34 at the proximal end for attachment of the insert member 14 to the eyelet tab 18' of the shoe 20. The means of attachment of the insert member 14 to the eyelet tab 18' is accomplished by inserting the locking nylon cable tie 22 first through the pair of apertures 34 and then through eyelets 24 of the eyelet tab 18'. The tapered end 26 of the locking nylon cable tie 22 is then inserted into a locking receiving end 28 of the cable tie. The tapered end 26 is pulled until the insert member 14 is securely attached to the eyelet tab 18' of the shoe 20, whereupon the tapered end 26 is cut off. In the preferred embodiment, the insert member 14 is attached with locking nylon cable ties 22, although other means of attachment may be used in alternative embodiments, e.g., lacing, either cloth, leather or synthetic, appropriately tied or otherwise secured. The insert tab 32 has hook-type fastening material 36 on the outer surface of the distal end of the insert tab, and is further covered with a complimentary patch of loop-type fastening material 37 on the outer surface of the proximal end of the insert tab.

In order to securely fasten the shoe 20 on the foot of the wearer, the insert tab 32 is first threaded through the slotted aperture 30 of the eyelet member 12, and is then folded back upon itself, bringing the hook-type fastening material 36 and the loop-type fastening material 37 in contact, thereby securely fastening the shoe 20 over the foot of the wearer. The present invention as shown in FIG. 1 has two shoe fastening devices 10 in use with a shoe, although fewer or more such devices may be used.

Figure 2:
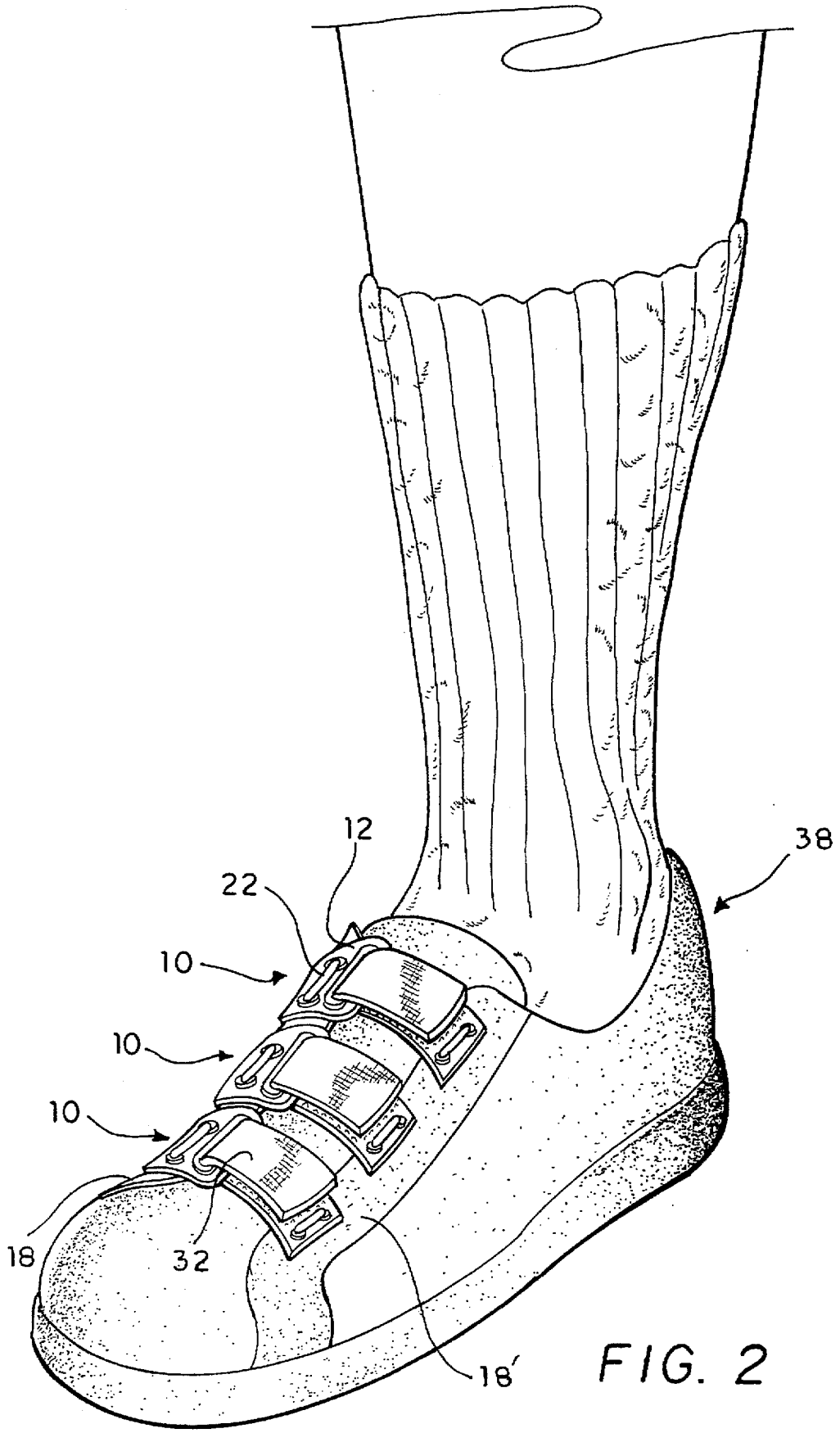
FIG. 2 is an environmental view of the present invention used in conjunction with an adult's shoe.
Figure 3:
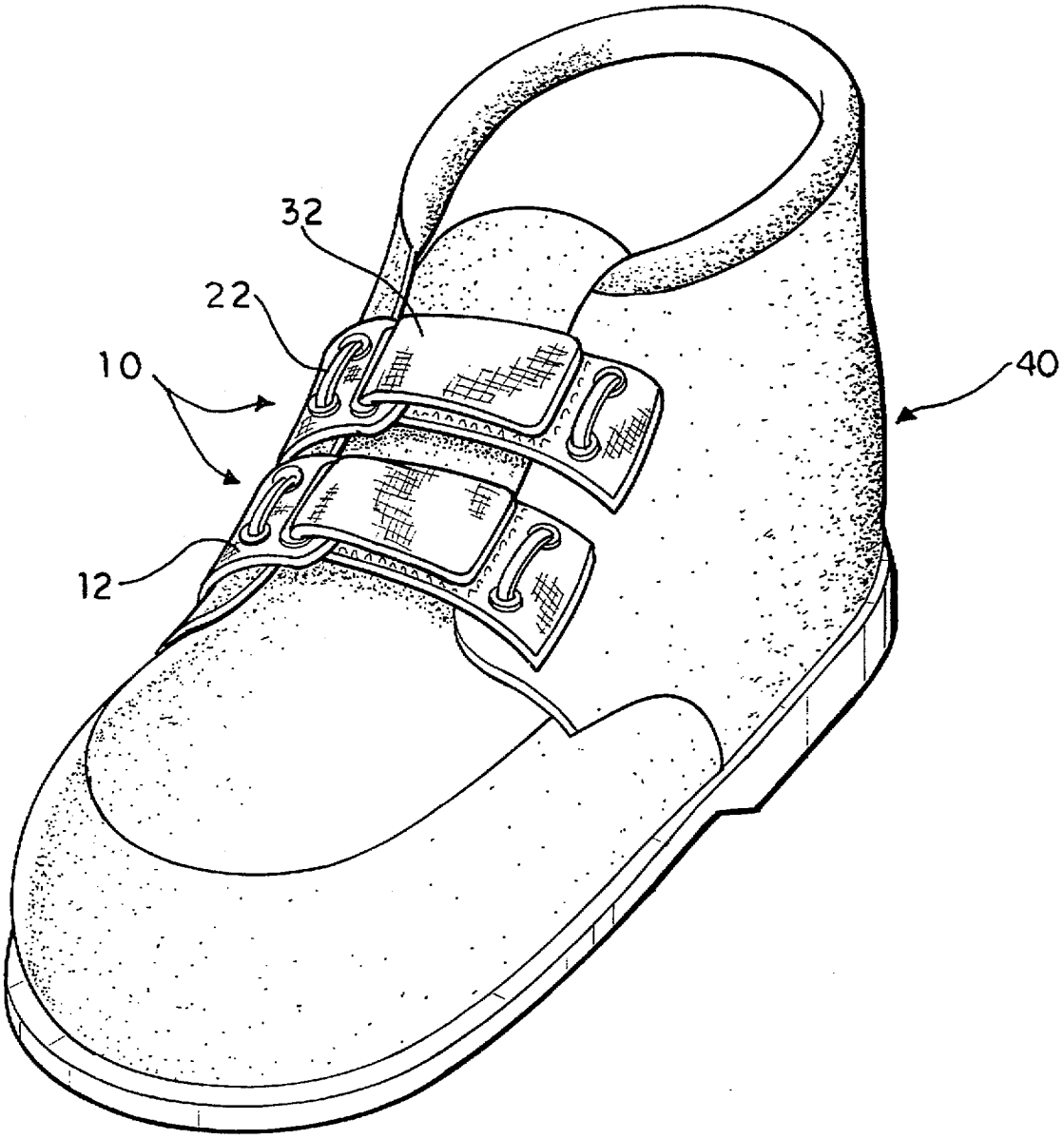
FIG. 3 is an environmental view of the present invention used in conjunction with a child's shoe.

Referring now to FIG. 2, an environmental view of the shoe fastening device 10 used in conjunction with an adult's shoe 38 is shown. The shoe 38 is shown with three such shoe fastening devices 10, each being identical to one another. FIG. 3 is an environmental view of the shoe fastening device 10 showing a pair of such shoe fastening devices in use with a child's shoe 40.

If the wearer desires to convert the shoe back to use with shoelaces, the wearer need simply cut the cable ties 22 and reinsert laces (not shown) through the eyelets 24. Additionally, should the shoe 20 wear out or the wearer desire to use the shoe fastening device 10 with another pair of shoes, the wearer need only to cut the cable ties 22 and reuse the device by attaching it to another pair of shoes using new cable ties 22.

It is to be understood that the present invention is not limited to the embodiments described above, but encompasses any and all embodiments within the scope of the following claims.

I claim:

1. A shoe fastening device for use with a shoe having a pair of opposed eyelet tabs containing a plurality of eyelets, the shoe fastening device comprising:

at least one eyelet member securable to one of the eyelet tabs on said shoe, said at least one eyelet member having a proximal end and a distal end comprising:

(1) a first pair of apertures at the said proximal end; and (2) a slotted aperture at said distal end;

a locking nylon cable tie for securing said at least one eyelet member to said one of the eyelet tabs on said shoe, said locking nylon cable tie passing through said first pair of apertures and the eyelets of said one of the eyelet tabs;

at least one insert member securable to the other of the eyelet tabs on said shoe, said at least one insert member having an outer surface, a proximal end and a distal end comprising:

(1) an insert tab insertible through said slotted aperture of said eyelet member;

(2) a second pair of apertures at the said proximal end; and (3) fastening means on the outer surface of said insert tab for removably securing said at least one insert member upon folding said at least one insert member upon itself;

means for securing said insert member to said other eyelet tab on said shoe, said means for securing said insert member to said other eyelet tab passing through said second pair of apertures and the eyelets of said other eyelet tab.

2. The shoe fastening device as defined in claim 1 wherein said eyelet member and said insert member are comprised of vinyl.

3. The shoe fastening device as defined in claim 1 wherein said eyelet member and said insert member are comprised of cloth.

4. The shoe fastening device as defined in claim 1 wherein said eyelet member and said insert member are comprised of leather.

5. The shoe fastening device as defined in claim 1 wherein said fastening means for removably securing said at least one insert member upon folding said at least one insert member back upon itself comprise hook-and-loop-type fasteners.

6. A shoe fastening device for use with a shoe having a pair of opposed eyelet tabs containing a plurality of eyelets, the shoe fastening device comprising:

at least one eyelet member securable to one of the eyelet tabs on said shoe, said at least one eyelet member having a proximal end and a distal end comprising:

(1) a first pair of apertures at the said proximal end; and (2) a slotted aperture at said distal end;

means for securing said at least one eyelet member to said one of the eyelet tabs on said shoe, said means for securing said at least one eyelet member passing through said first pair of apertures and the eyelets of said one of the eyelet tabs;

at least one insert member securable to the other of the eyelet tabs on said shoe, said at least one insert member having an outer surface, a proximal end and a distal end comprising:

(1) an insert tab insertible through said slotted aperture of said eyelet member;

(2) a second pair of apertures at the said proximal end; and (3) fastening means on the outer surface of said insert tab for removably securing said at least one insert member upon folding said at least one insert member upon itself;

a locking nylon cable tie for securing said insert member to said other eyelet tab on said shoe, said locking nylon cable tie passing through said second pair of apertures and the eyelets of said other eyelet tab.

7. The shoe fastening device as defined in claim 6 wherein said eyelet member and said insert member are comprised of vinyl.

8. The shoe fastening device as defined in claim 6 wherein said eyelet member and said insert member are comprised of cloth.

9. The shoe fastening device as defined in claim 6 wherein said eyelet member and said insert member are comprised of leather.

10. The shoe fastening device as defined in claim 6 wherein said fastening means for removably securing said at least one insert member upon folding said at least one insert member back upon itself comprise hook-and-loop fasteners.

* * * * *